United States Patent [19]

van der Werf et al.

[11] 4,051,407

[45] Sept. 27, 1977

[54] ARRANGEMENT INCLUDING A GAS AND/OR VAPOR DISCHARGE LAMP

[75] Inventors: Jan Evert van der Werf; Jean Johan Heuvelmans; Hendricus Franciscus Johannes Jacobus van Tongeren, all of Eindhoven, Netherlands

[73] Assignee: U.S. Philips Corporation, New York, N.Y.

[21] Appl. No.: 668,586

[22] Filed: Mar. 19, 1976

[30] Foreign Application Priority Data

Apr. 1, 1975 Netherlands ..... 7503826

[51] Int. Cl.[2] ..... H05B 41/14; H05B 41/36

[52] U.S. Cl. ..... 315/106; 315/98; 315/107; 315/260; 315/307; 315/334; 315/DIG. 1; 315/DIG. 5

[58] Field of Search ..... 315/73, 94, 98, 106, 315/107, 291, 307, 326, DIG. 1, DIG. 5, 260, 265, 334

[56] References Cited

U.S. PATENT DOCUMENTS

| | | | |
|---|---|---|---|
| 2,159,767 | 5/1939 | Liebich | 315/107 |
| 2,330,312 | 9/1943 | Raney, Jr. | 315/106 X |
| 2,668,259 | 2/1954 | Stutsman | 315/106 X |
| 3,072,822 | 1/1963 | Holmes | 315/107 |

*Primary Examiner*—Eugene R. LaRoche
*Attorney, Agent, or Firm*—Frank R. Trifari; Bernard Franzblau

[57] ABSTRACT

A device for operating a low-pressure sodium vapor discharge lamp without a ballast. The electrode voltage drop near a main electrode of the sodium lamp is influenced by a change in the pre-heating current of that electrode and/or a change in the effective area of the electrode. The changed electrode voltage drop thus obtained provides a mechanism whereby any changes in the lamp current are opposed so as to produce ballast-free lamp operation.

10 Claims, 3 Drawing Figures

ARRANGEMENT INCLUDING A GAS AND/OR VAPOR DISCHARGE LAMP

The invention relates to an arrangement including a gas and/or vapour discharge lamp which is provided with a discharge tube equipped with two main electrode systems, an auxiliary circuit being present for influencing the electrode voltage drop near at least one of those main electrode systems. The auxiliary circuit — in the operating condition of the lamp — reacts to a change in the effective current strength between the main electrode systems so as to change the electrode voltage drop in a manner to oppose the said change in the current between the main electrode systems thereby to provide ballast-free operation of the lamp.

The term electrode voltage drop, or electrode drop or electrode fall, means the difference in potential due to the space charge near an electrode (cathode and/or anode.

A known arrangement of the specified type is, for example, described in the German Patent Application No. N 1132 which was published on the 6$^{th}$ of August 1953.

A disadvantage of the known arrangement is that the electrode voltage drop is changed by means of a control grid. As a rule the location of such a control grid is particularly critical so that the manufacture of the lamp is difficult. Furthermore, the finished lamp is very vulnerable and is consequently not very reliable in operation.

It is an object of the invention to avoid, in an arrangement of the type indicated in the preamble, the specified disadvantages and to obtain, inter alia, high reliability in operation.

It should be noted that it is also taught in the known arrangement to provide at least one of the main electrode systems with a pre-heatable electrode, which electrode is used as the cathode.

An arrangement according to the invention is a device of the type indicated in the preamble wherein at least one of the main electrode systems comprises a pre-heatable electrode which is used as a cathode and is characterized in that the change in the electrode voltage drop is effected at least partly by a change in the magnitude of the preheating current of the preheatable electrode which is accomplished by means of the auxiliary circuit.

Another group of arrangements according to the invention are arrangements of the type indicated in the preamble, which are characterized in that the change in the electrode voltage drop is effected at least partly by a change in the magnitude, e.g. size or area, of a part of at least one of the main electrode systems, which part is used as an anode, the said magnitude change being effected by means of an auxiliary circuit.

An advantage of arrangements, of both groups, according to the invention, is that the complication of a vulnerable control electrode has been avoided - the reliability in operation may consequently be large - and that nevertheless a ballast -less operation of the discharge lamp is possible.

The auxiliary circuit could possibly be switched on and off by means of a bimetal element.

In a preferred embodiment of an arrangement according to the invention the auxiliary circuit comprises a relay and a measuring resistor for the control of the relay is included in a connection of an input terminal of the device to one of the main electrode systems of the discharge tube, a switching contact of the relay is either in series with the pre-heatable electrode of at least one of the main electrode systems or is included in an electrical connection between two anode parts of a main electrode system.

An advantage of this preferred embodiment is that the reliability in operation of the device can be further increased by means of this relay.

In a further preferred embodiment of a device according to the invention, which is destined for connection to a DC voltage source, the auxiliary circuits of the anode and the cathode are combined and provided with two coupled switching contacts so that in one position of those switching contacts the preheatable electrode receives a pre-heating current and the anode has a relatively large effective area, whereas in a second position of the switching contacts the preheatable electrode does not receive a pre-heating current and the anode has a relatively small effective area.

By controlling the electrode voltage drop at both the cathode and the anode side, a more stable operation of the discharge lamp is obtained. This is due to the fact that measures are now taken at both the cathode and at the anode to keep the discharge current constant.

In a further preferred embodiment of a device according to the invention, which is destined for connection to an AC voltage source, each of the two main electrode systems consists of a preheatable electrode and the auxiliary circuit switches the preheating of the two electrodes simultaneously on and also simultaneously off.

An advantage of this device is that it can be connected directly to an AC voltage, supply of a suitable voltage.

In another preferred embodiment of a device according to the invention, which is destined for connection to an AC voltage source, each of the two main electrode systems consists of a combination of a non-pre-heatable central electrode surrounded by a cylindrical anode, whereby the auxiliary circuit switches the two cylindrical anodes simultaneously on and also simultaneously off again.

An advantage of this device is also that it can be connected direct to an AC voltage mains of a suitable voltage.

The lamp may, for example, be a mercury vapour discharge lamp.

In a preferred embodiment of an arrangement according to the invention the lamp is a low-pressure sodium vapour discharge lamp. An advantage of this lamp is that it often has a positive voltage current characteristic so that the current control is less critical for this lamp. It is therefore possible to operate this lamp ballast-less in a relatively simple manner.

The invention will be further explained with reference to the accompanying drawing, in which.

Figure 1:
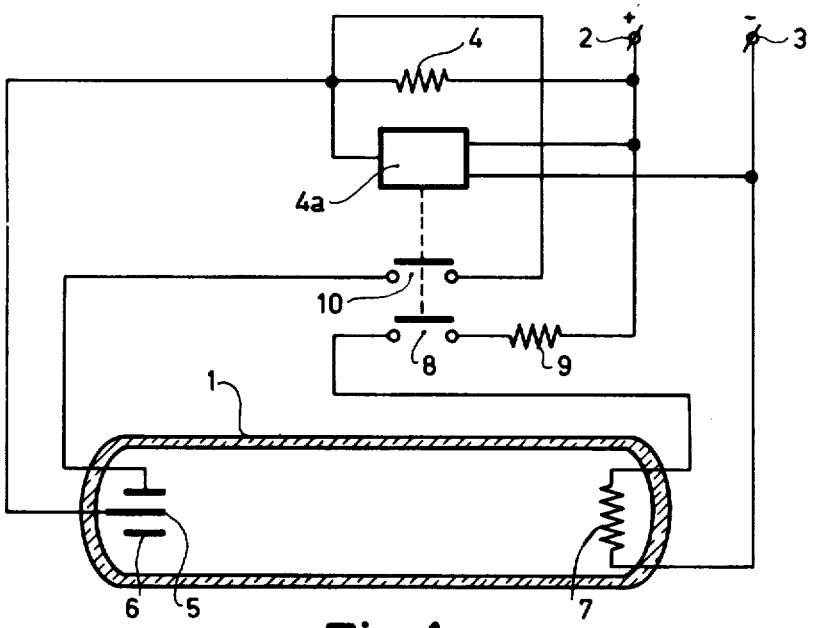
FIG. 1 shows a first arrangement according to the invention.

In FIG. 1 reference 1 is a diagrammatic representation of a low-pressure sodium vapour discharge lamp. Actually this lamp comprises, besides a discharge tube, also for example an outer bulb which envelopes this discharge tube. References 2 and 3 are input terminals which are destined for connection to a DC voltage source. Terminal 2 is connected to an anode 5 of the discharge lamp 1 through a resistor 4 of approximately one Ohm. Reference 6 indicates a second anode of the lamp 1. This anode 6 has the shape of a hollow cylinder. Reference 7 indicates a cathode of the lamp 1. One side of this cathode 7 is connected to input terminal 3, the other side of this cathode 7 is connected to a contact 8 of a control element 4a. This control element shunts the resistor 4 and comprises a level detector and a relay coil. The other side of the contact 8 is connected to terminal 2 of the device through a resistor 9. A second contact 10 of the control element 4a is on the one hand connected to a point located between the anode 5 and the resistor 4 and on the other hand to the cylindrical anode 6. In view of its supply the control element 4a is also connected to the terminal 3.

Said arrangement operates as follows. When the terminals 2 and 3 are connected to the relevant poles of a DC voltage source, a high frequency high voltage is also applied for a short time between the electrodes 5 and 7 through an auxiliary device, not shown here. The lamp ignites subsequently. Then the discharge current between electrodes 5 and 7 will at first have a relatively low value. At this low value the contact of the relay will be closed so that both the auxiliary anode 6 and also the pre-heating of the electrode 7 are switched on. Thereafter the electrode 7 is heated still more and the discharge current between electrode 7 on the one hand and electrodes 5 and 6 on the other hand increases. This continues until the operating condition of the lamp is reached. Should the current between the electrode 7, which functions as a cathode, and the anode electrodes 5 and 6 become too large then the relay will open the contacts 10 and 8 and no further pre-heating of the cathode 7 will occur. Moreover, the effective area of the anode will be limited to that of the electrode 5 only. Now the current strength in the lamp decreases again. Should that current strength then decrease to below a given level, again one has the situation that the contacts 10 and 8 are closed etc.

In a practical embodiment the supply voltage is approximately 100 volts. The lamp is a low-pressure sodium vapour discharge lamp of approximately 90 watts and the current strength varies between 0.85 amperes and 0.95 amperes. The length of the discharge path is approximately 80 cms.

Figure 2:
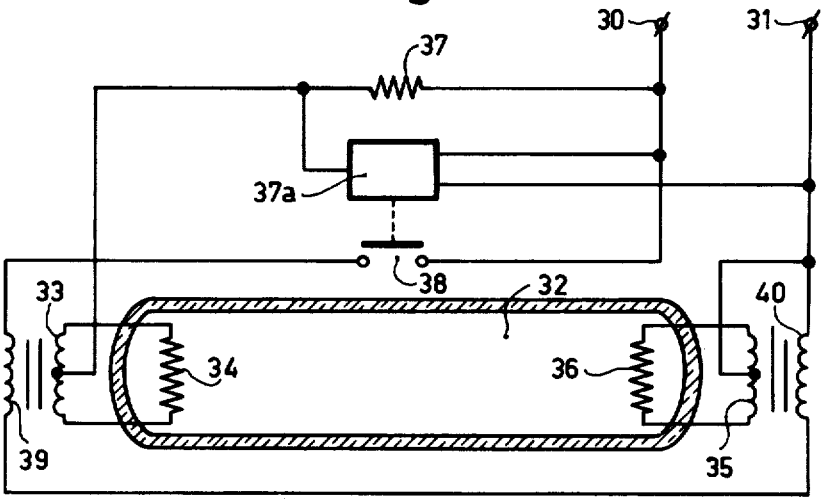
FIG. 2 shows a second arrangement according to the invention.

In FIG. 2 references 30 and 31 are terminals which are destined to be connected to a square-wave AC voltage of approximately 100 volts, 50 Hz. Terminal 30 is connected to the centre of a transformer winding 33 through a resistor 37 of approximately one Ohm. A pre-heatable electrode 34 of a diagrammatically-represented low-pressure sodium vapour discharge lamp 32 is connected across the ends of this winding 33. In a similar way the terminal 31 is connected to the centre of a transformer winding 35. A pre-heatable electrode 36 of the lamp 32 is connected across the ends of the winding 35. The resistor 37 is shunted by a control element 37a which comprises inter alia a level detector and a relay coil. A switching contact of the relay is indicated by 38. One side of this contact is connected to the terminal 30 and the other side is connected to a transformer winding 39 which is coupled with the winding 33. The other side of the winding 39 is connected to a winding 40 which is coupled with the winding 35. The other side of the winding 40 is connected to the terminal 31.

The arrangement described of in FIG. 2 operates as follows. The terminals 30 and 31 are connected to the indicated AC voltage source. Thereafter a voltage is again applied between the electrodes 34 and 36 by a high frequency high voltage source which is not shown here, whereafter the lamp ignites. Thereafter, due to the fact that the lamp starts again at a low lamp current value, first the contact 38 of the relay will be closed, which means that the two pre-heatable electrodes 34 and 36 receive a pre-heating current. This causes the discharge current of the lamp to increase. Should, however, this lamp current attain too high a value, then the relay will open the contact 38 which causes the pre-heating currents of the electrodes 34 and 36 to be cut-off. Consequently the lamp current decreases again. Should this current again fall to below a given level the relay will again close contact 38 so that an electrode pre-heating occurs again etc. The electrodes 34 and 36 have been rated in such a way that they are only slightly heated by the discharge current when the pre-heating has been switched off.

In a practical embodiment the lamp is a low-pressure sodium discharge lamp of approximately 90 watt. In this case the lamp current varies between 0.85 amperes and 0.95 amperes.

Figure 3:
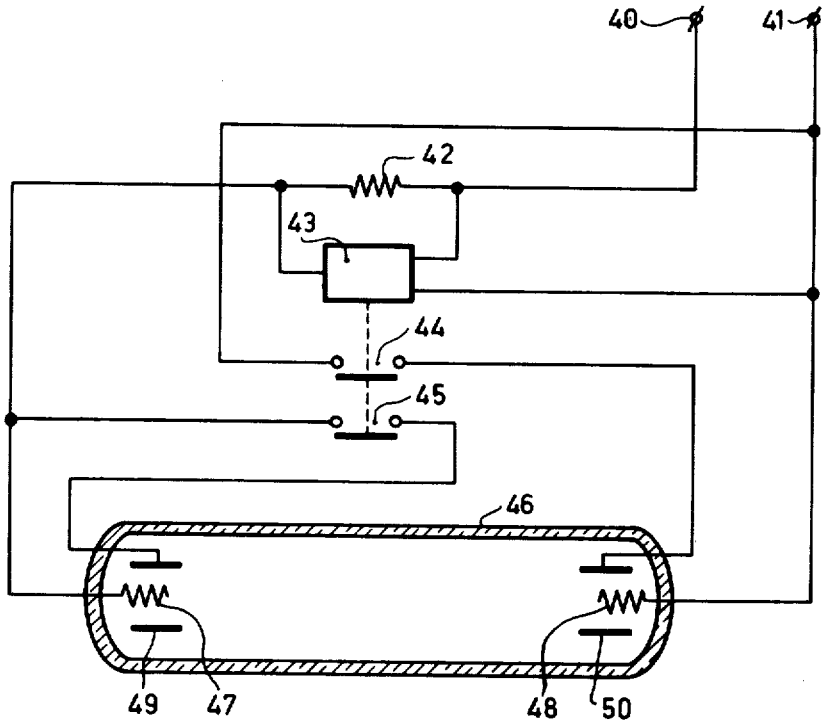
FIG. 3 shows a third arrangement according to the invention.

In FIG. 3 references 40 and 41 are terminals which are intended for connection to a square wave AC voltage of 100 Volts, 50 Hz. The circuit of FIG. 3 closely resembles that of FIG. 2. There is again a resistor 42 of approximately one Ohm which is connected to an input terminal 40. The resistor 42 is shunted by a control element 43 which now, however, controls two contacts 44 and 45 simultaneously. A low-pressure sodium vapour discharge lamp 46 has at both ends a central non-pre-heatable electrode (47 and 48 respectively) and a cylindrical anode (49 and 50 respectively). At a low lamp current strength, i.e. a low current strength through the resistor 42, a relay which is included in the control element 43 has been de-energized so that the two contacts 44 and 45 are open and consequently the cylindrical anodes 49 and 50 are switched off. At a relatively large lamp current the relay connects the two contacts 44 and 45 so that the two cylindrical anodes 49 and 50 are switched on.

The operation of the circuit of FIG. 3 is based on the following. When the lamp current is large a cylindrical anode 50 near a lamp end is additionally switched on to achieve that, in the phase that this main electrode system 48, 50 acts as the anode, the central electrode 48 is heated less by the discharge current (for a large part of the discharge current then flows through the cylindrical anode 50) so that this main electrode system can not emit so well in the cathode phase.

In this respect it should be noted that the fact that the cylindrical anode is additionally switched on during the anode phase of the main electrode system (at large lamp current) creates an effect in the wrong direction, but in view of the fact that the decreased emission in the cathode phase of this main electrode system greatly exceeds said disturbing effect a desired total control of the lamp in the intended direction (reducing the effective discharge current again) is nevertheless obtained.

It is conceivable that in another device according to the invention each of the main electrode systems, when supplied from an AC voltage supply, consists of a combination of a non-pre-heatable electrode with an electrode which is pre-heatable.

What is claimed is:

1. Apparatus for operating an electric discharge lamp substantially free of any ballast device comprising, a pair of input terminals for applying electric power to the apparatus, a substantially impedance free electric coupling means connecting the discharge lamp across the input terminals, said discharge lamp having first and second main electrode systems defining a discharge path through the lamp, one of said electrode systems comprising a preheatable electrode operable as a cathode, an auxiliary circuit responsive to the lamp current flow between the first and second main electrode systems and including means for altering the electrode voltge drop in the vicinity of at least one of said main electrode systems, said auxiliary circuit, in the operating condition of the discharge lamp, being responsive to a change in the effective value of the current flowing between the lamp first and second main electrode systems so as to change said electrode voltage drop in a manner such as to oppose said change in current between said first and second main electrode systems, said change in the electrode voltage drop being effected at least partly by changing the magnitude of the heating current supplied to said preheatable electrode.

2. An apparatus as claimed in claim 1 wherein the auxiliary circuit comprises a relay and the electric coupling means includes a measuring resistor for controlling the relay and connected between an input terminal and one of the main electrode systems of the discharge lamp, the relay including a switching contact connected in series with the preheatable electrode for controlling the flow of current thereto.

3. Apparatus as claimed in claim 1 characterized in that the lamp comprises a low-pressure sodium vapour discharge lamp.

4. Apparatus as claimed in claim 1 wherein one of the main electrode systems is made up of two anode members and the auxiliary circuit comprises a relay and the electric coupling means includes a low-ohmic measuring resistor for controlling the relay and connected between an input terminal and one of the lamp main electrode systems, the relay including a switching contact electrically coupling the two anode members.

5. An apparatus as claimed in claim 1 wherein the auxiliary circuit includes a relay and the electric coupling means includes a low-ohmic resistor connected between an input terminal and one of the lamp main electrode systems for controlling the relay, the relay including first and second coupled switching contacts switchable between first and second positions, said first and second switching contacts being connected so that in the first position the preheatable electrode receives a heating current via the first contact and the other lamp electrode system and the anode is arranged via the second contact to have a relatively large effective area, and in the second position of the contacts the preheatable electrode receives no heating current and the anode is arranged via the second contact to have a relatively small effective area.

6. Apparatus as claimed in claim 1 wherein said input terminals are adapted to be connected to an AC power source, each of the two main electrode systems comprise a preheatable electrode, and said auxiliary circuit includes switching means responsive to the lamp current and connected so as to simultaneously switch a heating current on and off to the two preheatable electrodes.

7. Apparatus as claimed in claim 8 wherein said auxiliary circuit includes switching means responsive to the lamp current between said first and second electrode systems for controlling the flow of heating current from the input terminals to the preheatable electrode via a circuit that is independent of the lamp discharge path thereby to provide ballast-free operation of the lamp.

8. Apparatus for operating an electric discharge lamp substantially free of any ballast device comprising, a pair of input terminals for applying electric power to the apparatus, a substantially impedance free electric coupling means connecting the discharge lamp across the input terminals, said discharge lamp having two main electrode systems one of which is operable as the lamp anode, an auxiliary circuit responsive to the lamp current between said two main electrode systems and including means for altering the electrode voltage drop in the vicinity of at least one of said main electrode systems, said auxiliary circuit, in the operating condition of the discharge lamp, being responsive to a change in the effective value of the current flowing between said two main electrode systems so as to change said electrode voltage drop in a manner such as to oppose said change in current between said two main electrode systems, said change in the electrode voltage drop being effected at least partly by changing the effective area of the lamp anode.

9. Apparatus as claimed in claim 8 wherein said input terminals are adapted for connection to an AC voltage source, each of the two main electrode systems comprising a combination of a non-pre-heatable central electrode surrounded by a cylindrical anode, and wherein the auxiliary circuit switches the two cylindrical anodes simultaneously on and simultaneously off.

10. Apparatus as claimed in claim 8 wherein the other of said two electrode systems comprises a preheatable electrode, and said auxiliary circuit voltage drop altering means includes switching means responsive to the lamp current between the two electrode systems for controlling the flow of heating current from the input terminals to the preheatable electrode.

* * * * *